US007634990B1

(12) United States Patent
Gartland

(10) Patent No.: US 7,634,990 B1
(45) Date of Patent: Dec. 22, 2009

(54) ARROW REST TETHER CLAMP

(76) Inventor: William J. Gartland, 6708 Bowman Ave., Youngstown, OH (US) 44515

( * ) Notice: Subject to any disclaimer, the term of this patent is extended or adjusted under 35 U.S.C. 154(b) by 417 days.

(21) Appl. No.: 11/197,074

(22) Filed: Aug. 3, 2005

(51) Int. Cl.
*F41B 5/22* (2006.01)

(52) U.S. Cl. ..... 124/44.5; 124/25.6

(58) Field of Classification Search ..... 124/25.6, 124/44.5, 86, 87, 90, 91
See application file for complete search history.

(56) References Cited

U.S. PATENT DOCUMENTS 2,905,166 A * 9/1959 Niemeyer ..... 124/91
4,552,121 A * 11/1985 Treaster ..... 124/87
4,848,306 A * 7/1989 Treaster ..... 124/24.1
4,965,938 A * 10/1990 Saunders ..... 33/265
6,595,472 B1 * 7/2003 Pisczak ..... 248/74.1
6,739,321 B1 * 5/2004 Puchlerz ..... 124/44.5
2005/0095062 A1 * 5/2005 Iverson et al. ..... 403/374.3

* cited by examiner

*Primary Examiner*—John Ricci
(74) *Attorney, Agent, or Firm*—Gregory J. Nelson

(57) ABSTRACT

A clamp attachable to the buss cable of a compound bow. The clamp has a location for securement of the arrow rest tether. The clamp has mating body sections joined by adjustable fasteners.

1 Claim, 1 Drawing Sheet

ARROW REST TETHER CLAMP

FIELD OF THE INVENTION

The present invention relates to an accessory for an archery bow and more particularly to a clamp securable to a bow buss cable to provide a location for attaching the end of the tether of a fall away arrow rest.

BACKGROUND OF THE INVENTION

Arrow rests for archery bows are commonly used and are provided to support an arrow before and during release. Arrow rests are usually positioned on a lateral extension of the mid-portion of the bow and permit the archer to steady and accurately aim and release the arrow from the bow.

It is preferred the arrow rest not disturb or interfere with the intended flight of the arrow, even if the arrow engages the arrow rest during launching of the arrow. Accordingly, many arrow rests, particularly the type used with compound bows, are pivotally mounted to the bow and termed "fall away" rests. A tether or cord extends from the bow to one of the bow strings, usually the upward moving buss cable associated with the compound bow pulley arrangement. When the arrow is placed in the shooting position with the arrow shaft resting in the support of the arrow rest and the bow string is drawn, the tether will cause the arrow rest to pivot or rotate to a generally horizontal position. When the bow string is released, the tether is also released allowing the arrow rest to rapidly pivot downwardly to fall away to an out-of-the-way position avoiding interference with the launched arrow.

The point of attachment of the end of the tether to the up-bowstring or cable will determine the position of the arrow rest when the bowstring is fully drawn. Many archers simply tie the end of the tether to the buss cable using a conventional knot. The disadvantage is that the knot can tend to slip along the cable during use which will then alter or change the position of the arrow rest when the bowstring is fully drawn.

BRIEF SUMMARY OF THE INVENTION

Briefly, it is a primary object of the present invention to provide a clamp which is attachable to the up-bowstring or cable and which provides a location to which the distal end of the tether can be secured. Once the clamp is secured, it will resist slipping and dislodgement over a period of use.

The tether clamp of the present invention has a body comprised of two mating sections which are secured by fasteners such as small threaded fasteners and nuts. One of the sections carries an attachment location such as a projecting flange which defines a bore to which the distal end of the tether can be secured. A longitudinal groove extends through the body to receive the buss cable to which the clamp is to be attached. The cable may be received in a split sleeve. Once the cable is inserted in the sleeve, the clamp body sections are tightened positioning the clamp in a suitable location so when the bow is fully drawn, the arrow rest is in the proper location for launching. The location of the tether clamp can be adjusted by loosening the fasteners and sliding the clamp along the cable.

The tether clamp of the present invention is adaptable for use with most conventional compound bows and is simple and easy to install and use.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
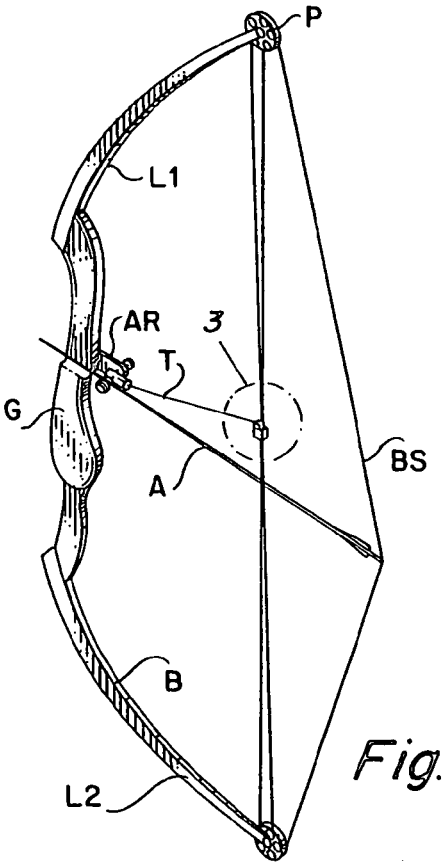
FIG. 1 is perspective view of a representative bow of the compound type with an attached arrow rest having a tether secured to the up-bowstring by a tether clamp of the present invention.

Turning now to the drawings, particularly FIG. 1, a representative bow B is shown which is shown as a compound bow of the type having a handle portion with the grip G and opposite upper and lower limbs L1 and L2. The bow may be constructed from any suitable material. Commonly bows of this type have limbs of fiberglass or laminated composite materials. Typically the bow will include an arrow rest pivotally mounted above the grip. The bow has a bowstring BS which is connected to one of the pulleys or cams P at the end of the upper and lower limbs. Pulley systems are well known and allow the user the more easily draw the bowstring, particularly bowstrings which are tensioned to provide greater power. An arrow A is ready for launching by placing the nock of the arrow in engagement with bowstring BS and aligning the tip of the arrow with the intended target. The arrow rest AR is shown as the pivotal type or drop down type which will assist in steadying the arrow during the aiming and launching procedure. The arrow rest is attached by a tether T to the up-buss cable BC. Thus, as the bowstring and arrow nock is drawn rearwardly, the tether will cause the arrow rest to pivot upwardly to the launching position. Conventionally the tether is secured to the pulley string or cable by a simple knot which, as pointed out above, may slip or slide along the cable during use which will then affect the position of the arrow rest when the bowstring is fully drawn.

The tether clamp of the present invention is generally designated by the numeral 10 and has a body 12 having engaging body sections 14 and 16. Body section 14 is generally rectangular having an exterior or outer face 20 and inner face 22. The body sections may be any suitable, durable material such as nylon. An axial groove 25 extends from the upper end of the body section 14 to the lower end along the inner face. The groove 25 is generally semi-circular in cross-section and is sized to either conform to the cross-section of the cable BC or to the size of a sleeve 40 which receives the pulley cable. Sleeve 40 may be plastic or metal and is preferably longitudinally slit at 41 so it may be placed about the string or cable.

A pair of spaced-apart bores 32, 34 extend through the body section 14 between the outer and inner faces 20, 22. The bores have an enlarged countersunk section 36 at the outer face.

Figure 2:
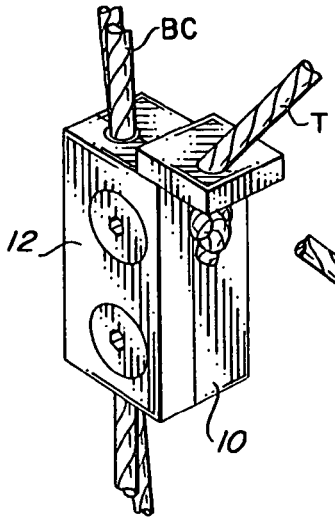
FIG. 2 is a perspective view of the tether clamp of the present invention.
Figure 3:
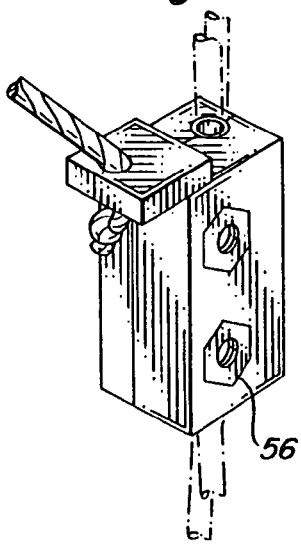
FIG. 3 is a perspective view of the tether claim of the present invention viewed from the opposite side as seen in Figure.

The opposite body section 16 is similarly dimensioned and when the body sections are abutted form a rectilinear unit as seen in FIGS. 2 and 3, although this shape is preferred, body sections may be other shapes such as semi-cylindrical. Body section 16 has an outer face 50 and inner face 52 with a generally semi-circular groove 25A extending from the upper end of the body at the lower end along the inner face. The grooves 25, 25A in the body sections align to receive either the cable BC or sleeve 40 around the bowstring as described above and as best seen in FIG. 5. The outer surface of the body section 16 defines a spaced-apart recess 56 which is shown as generally hexagonal to receive nuts 58. Bores 32A, 34A in the body section align with bores 32, 34 so the fasteners 70 may extend through the body sections and be placed in threaded engagement with the nuts 58. When the fasteners are fully tightened, both the heads 75 of the fasteners and the nuts 58 are flush with their respective surfaces.

Figure 6:
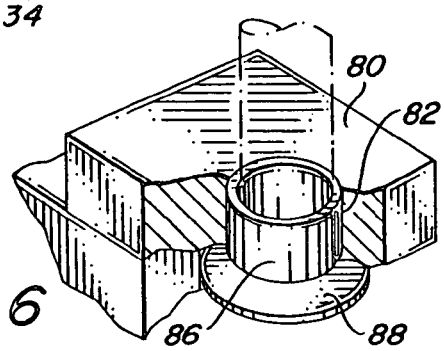
FIG. 6 is a detail view of the flange portion of the tether clamp broken away to illustrate the insertion of an optional grommet.

The upper end of the body section 16 carries an attachment location for the tether which is shown as a forwardly projecting flange 80 which is integrally formed with the body. The flange has a through bore which is sized to receive the distal end of the tether. As best seen in FIG. 6, the tether is pulled through the through bore adjusting it to the proper length. Then tether T can be tied off by knot K at the lower end of the through bore 86. As seen in FIG. 6, the through bore 82 may also be provided with a grommet 85 having a sleeve 86 and a flange 88. The grommet may be of metal or a suitable plastic material and inserted in the through bore for reduced friction and improved wear-resistance.

Figure 7:
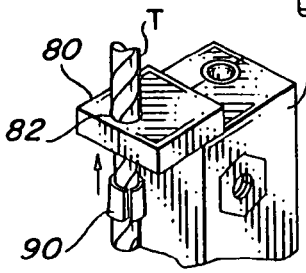
FIG. 7 is a detail perspective view of the clamp of the present invention showing a tether extending through the flange and secured by a split sleeve crimped around the distal end of the tether.

The user may prefer to secure the tether by using a clamp or sleeve instead of a knot as the sleeve will be easier to precisely adjust along the tether. Referring to FIG. 7, the tether is shown extending through the through bore 82 in the flange of the tether clamp. A small split sleeve 90 of plastic or metal has been secured around the tether. The user can then adjust the tether to the appropriate length and slide the sleeve into engagement with the underside of the flange 80 clamping the sleeve in this position.

Figure 5:
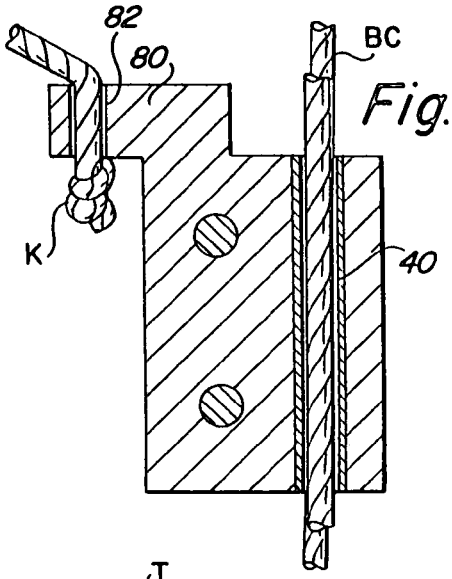
FIG. 5 is a vertical cross-sectional view of the tether clamp of the present invention showing the clamp attached to bowstring and showing a tether attached to the clamp.
Figure 4:
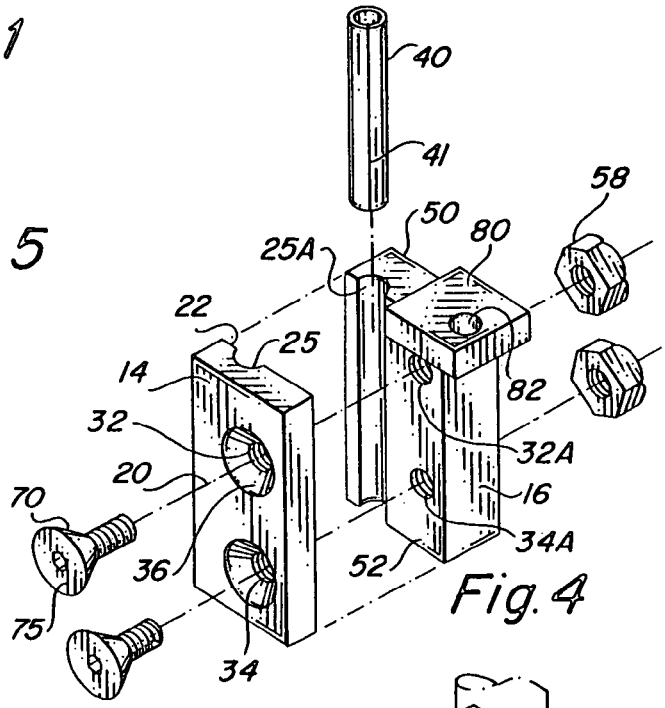
FIG. 4 is an exploded view of the tether clamp of the present invention.

In use, the tether clamp 10 will be disassembled or at the least the fasteners 70 loosened to allow the buss cable to be inserted into the aligned grooves 25, 25A in the body sections of the clamp. Preferably a split sleeve 40 has been first installed on the bowstring and inserted in between the sections. The user can then slightly tighten the fasteners, still allowing some movement of the clamp along the bowstring. The user will then insert the distal end of the tether T into the through bore 82 in the tether clamp. By experimentation and trial and error, the user can determine the proper position of the tether clamp by pulling the bowstring BS rearwardly with an arrow A in position on the arrow rest with the nock engaged with the bowstring. The user may wish to mark the tether and the cable once the proper tether length and location of the tether clamp has been established. Once the proper tether length has been established, the user can ease the draw back down. Good practice is to never release the string of a bow without an arrow in place. The user can then secure the tether and clamp at the identified marks or locations by tightening the fasteners which will cause the two sections 14, 16 to apply a clamping force to the sleeve 40 and bowstring BS. The tether, which is inserted through its through bore, may be secured either by tying a knot in the end of the tether and clipping off any excess as seen in FIG. 5. Alternatively, the user may wish to install a small split sleeve on the tether and clamp it in place adjacent or abutting the underside of the flange.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A method of securing the tether of an arrow rest of an archery bow having a bowstring and an up-cable, said method comprising:

(a) providing a clamp having a body with first and second abutting sections defining a groove extending through the body for receiving the cable;

(b) providing fastening means for loosening or tightening said body sections relative to one another;

(c) providing attachment means on said body for receiving the distal end of said tether;

(d) positioning said clamp at a selected location on said up cable and tightening said fastening means to secure said body to said up cable; and (e) securing said tether to said attachment means whereby said tether will cause said arrow rest to move to a proper launch position when said bowstring is pulled rearwardly.

* * * * *